US006578510B1

(12) United States Patent
Scruggs et al.

(10) Patent No.: US 6,578,510 B1
(45) Date of Patent: Jun. 17, 2003

(54) ARTICULATED, COLLAPSIBLE BOAT BOARDING APPARATUS

(76) Inventors: Larry W Scruggs, 8205 N. Orleans Ave., Tampa, FL (US) 33604; Carolyn Redden Scruggs, 8205 N. Orleans Ave., Tampa, FL (US) 33604

( * ) Notice: Subject to any disclaimer, the term of this patent is extended or adjusted under 35 U.S.C. 154(b) by 0 days.

(21) Appl. No.: 10/173,487

(22) Filed: Jun. 17, 2002

(51) Int. Cl.[7] ..... B63B 29/20
(52) U.S. Cl. ..... 114/362
(58) Field of Search ..... 114/362; 182/81, 182/82, 88, 90, 91, 95, 97, 127, 86

(56) References Cited

U.S. PATENT DOCUMENTS 2,536,966 A * 1/1951 Teller
4,538,314 A 9/1985 Baranowski
4,907,673 A * 3/1990 Ginter et al. ..... 182/81
5,829,380 A 11/1998 Smith
6,119,809 A 9/2000 McClendon, Jr.
6,182,598 B1 * 2/2001 Bozzo ..... 114/362

* cited by examiner

*Primary Examiner*—Ed Swinehart

(57) ABSTRACT

A series of frames or sections, some of which are intended for the attachment of material resulting in planar surfaces suitable for walking or stepping upon, securely and sequentially hinged together in a linear manner, with supporting elements, mountable to a boat or other structure, which collapses into a compact space when closed, and when open presents a stable ramp-like device, providing a new method and apparatus for safe transport between a boat, or other structure, and water.

13 Claims, 5 Drawing Sheets

ARTICULATED, COLLAPSIBLE BOAT BOARDING APPARATUS

CROSS-REFERENCE TO RELATED APPLICATIONS

Not applicable.

BACKGROUND—FIELD OF INVENTION

This invention relates to boat boarding systems and apparatus.

STATEMENT REGARDING FEDERALLY SPONSERED RESEARCH OR DEVELOPMENT

Not applicable.

SEQUENCE LISTING

Not applicable.

BACKGROUND OF INVENTION

Thousands of people who go boating do so with their dogs, creating the need for a safe and convenient method for providing access to and from boat and water for dogs. Because conventional boat boarding ladders require the use of hands, various alternative designs have been created for usage by dogs. However, the designs currently available do not adequately address the needs of many boaters, necessitating the invention of a new method and apparatus for entering and exiting water for boating dogs.

One such design is taught in U.S. Pat. No. 6,119,809 to McClendon, Jr. (2000), featuring a folding platform for attachment to the side of a small boat. This method is problematic in that the two stage design does not readily adapt to a larger boat where the distances between platforms can become too great for a dog to safely move from one platform to the other.

Another invention for boat boarding by dogs is described in U.S. Pat. No. 4,538,314 to Baranowski (1985), featuring an adjustable ramp comprising a single planar member for attachment to the side of a small boat. The use of a single, rigid planar member for the device can be problematic in that a ramp scaled for a larger vessel may result in the planar member being too large for convenient implementation and storage. Also, the placement of the supporting brackets below the waterline may adversely affect boating performance while the ramp is in place. However, Baranowski and others teach the advantages of having a submerged step or platform for a dog in the water to gain initial purchase on the device.

A third design is taught by U.S. Pat. No. 5,829,380 to Smith (1998). While Smith also presents the advantage of a submerged area of the device to provide initial footing for a dog in the water, the main shortcoming of this device is that the support for the ramp is provided by adjustable floatation affixed underneath the end of the planar member which extends into the water. This is problematic in that it is not always possible to make adjustments to provide adequate support if more than one dog attempts to use the ramp simultaneously, or if dogs of significantly different weights need to use the same ramp between adjustments. Also, the use of attached floatation does subject the ramp, the connective hardware, and the vessel to which it is connected, to the effects of wave action upon the ramp, which can be problematic to the involved structures and to the users of the ramp.

By the examples cited, the applicants propose that the inventions shown in the prior art suffer from one or more of the following disadvantages:

(a) Their designs fail to adequately address inherent problems of ramp stability.

(b) Their designs may not be adaptable to differently sized vessels or other structures.

(c) They do not show utility for dogs of differing sizes and weights.

(d) While deployed, they may negatively impact boat performance.

(e) They are not convenient to implement or stow.

SUMMARY

In accordance with the present invention, an articulated, collapsible boat boarding apparatus comprises a series of sequentially hinged frame elements or sections, supported by pivoting structural elements when in the open position, interconnected in such a fashion as to collapse together in a compact manner when closed, wherein the sections provide the basis for attachment of material or fabric, wherein a combination of section and attached material presents a substantially planar surface suitable for walking upon, wherein the sequentially hinged sections with attached material, in the open position, comprise a stable, ramp-like device with suspended step, for safe entrance and exit between a boat, or other structure, and water.

OBJECTS AND ADVANTAGES

Accordingly, besides the objects and advantages of the boat boarding apparatus described in our disclosure, several objects and advantages of the present invention are:

(a) to provide a method for the safe and practical entrance and exit between a boat, or other structure, and water that is effective and convenient for usage by dogs;

(b) to provide a method that easily folds into a compact space when not in use;

(c) to provide a method that is easily deployed for use;

(d) to provide a method of highly adaptable design that may be permanently or removably attached to a boat or other structure;

(e) to provide a method that can be scaled for application with variously sized boats or other structures;

(f) to provide for usage by dogs large or small without adjustment;

(g) to provide a device whose stability is not dependent upon water and associated wave action;

(h) to provide an assembly of sections to which a variety of materials may be attached, in a variety of predetermined ways, wherein the sections with attached material form essentially planar surfaces suitable for walking or stepping upon.

Further objects and advantages are to provide a lightweight, strong structure, possibly portable in nature, comprising a series of sequentially hinged frame sections with pivotally attached supporting elements, constructed of any suitable materials such as, but not limited to, steel, aluminum, plastic, fiberglass, composites or alloys. Some sections provide a basis for the attachment of suitable materials by any suitable method, for the creation of planar surfaces suitable for walking or stepping upon. Thusly, when in the open position, the apparatus does present an essentially rigid, ramp-like device for the safe transport of dogs between a boat, or other structure, and water. Another object and advantage is to provide an inventive device adaptable for human usage. Still further objects and advantages will become apparent from a consideration of the ensuing description and figures.

PHOTOGRAPHIC FIGURES

REFERENCE NUMERALS IN PHOTOGRAPHS

Figure 1:
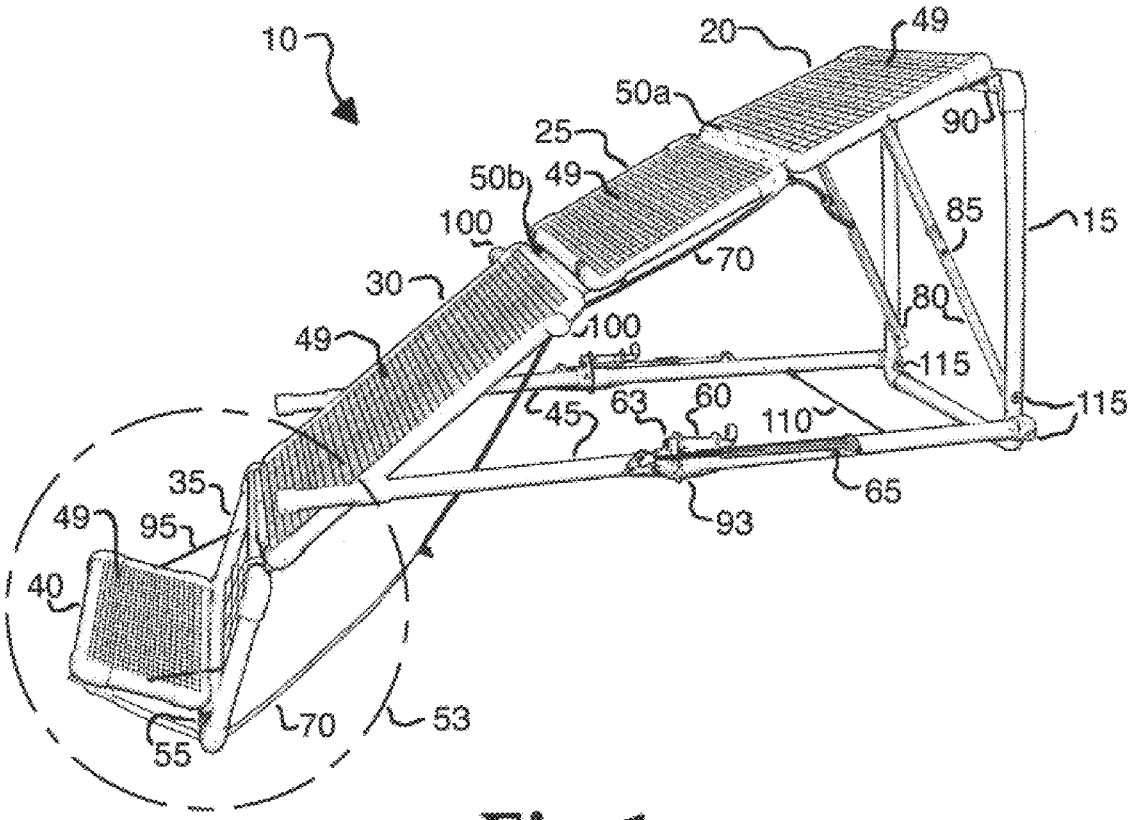
FIGS. 1 is a photograph of the boat boarding apparatus in the fully opened position, in accordance with the present invention.
Figure 3:
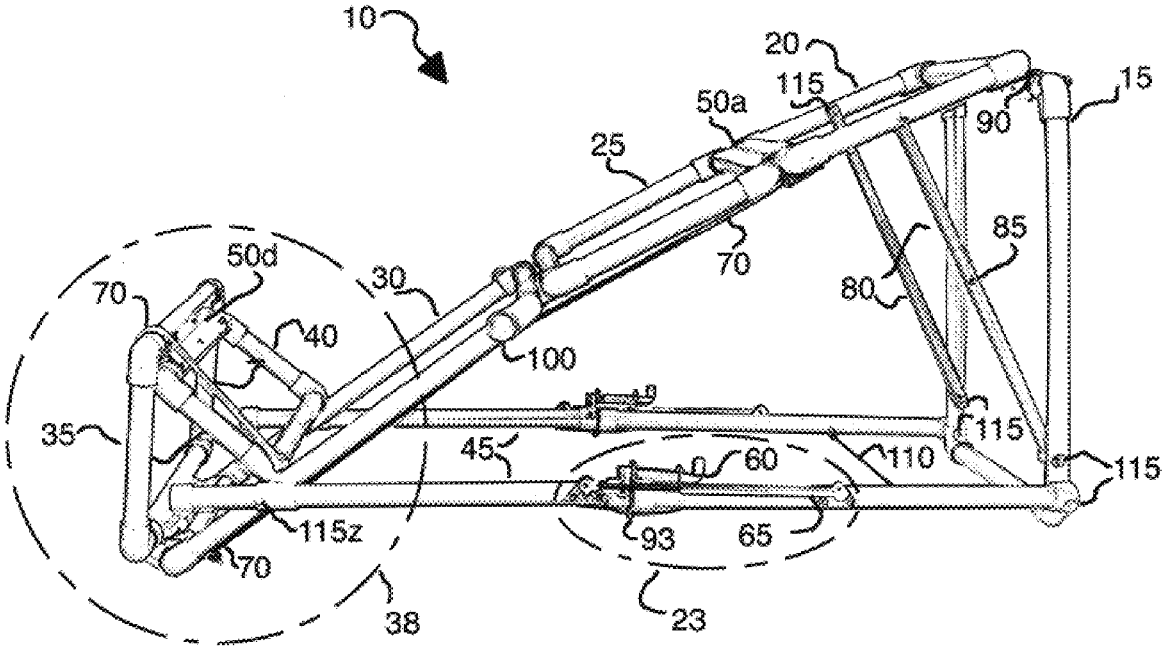
FIG. 3 is a photograph of the boat boarding apparatus in an almost completely open position.

10 Boat boarding apparatus
15 Base section
20 Upper ramp section
23 Portion of FIG. 3
25 Middle ramp section
30 Lower ramp section
38 Portion of FIG. 3
35 Vertically suspending section
40 Step section
45 Folding support arm
50 Continuous hinge
53 Portion of FIG. 1
55 Plain bearing
60 Latch
63 Latch receiver
65 Pneumatic damper
70 Controlling line
75 Holding line
77 Holding strap
80 Telescoping support
85 Snap button
90, 93 Strap hinge
100 Bumper
110 Restraining line
115 Pivot-providing fastening element

DESCRIPTION

FIGS. 1–8—Illustrated Embodiment

FIG. 1 depicts the illustrated embodiment of the inventive device, generally indicated at 10, in the fully open position. The boat boarding apparatus may be formed of metal, plastic, fiberglass, composites or any other suitable material, tubular or solid in nature, of any cross sectional design, as deemed appropriate by those skilled in the art. The boat boarding apparatus generally comprises a series of sequentially and securely hinged rectangular frame sections connected to support elements. Components include a vertically oriented base section 15, folding support arms 45, telescoping support elements 80, an upper ramp section 20, a middle ramp section 25, a lower ramp section 30, a vertically suspending section 35, and a horizontally disposed step section 40. Ramp sections 20, 25, and 30, as well as step section 40, serve as frames for the attachment of materials (not shown) deemed appropriate by those skilled in the art, whereby the ramp sections 20, 25, and 30 and step section 40, with attached material, form essentially planar elements suitable for walking upon. Suspending section 35 serves as a frame for the attachment of netting or other suitable barrier-forming material (not shown).

In the illustrated embodiment of FIG. 1, base section 15 is permanently or removably mountable, via its bottom surface, to an essentially vertical element of a boat or other structure (not shown) in any numbers of ways available to those skilled in the art, with the method of attachment being separate from and beyond the scope of this inventive device. Folding support arms 45 are attached at one end to base section 15 via a fastening element 115 that allows arms 45 to pivot relative to base section 15. In this embodiment, all of the fastening elements 115 are bolts with nuts, but the applicants realize that other means of pivot-providing attachment may be used. The opposite ends of arms 45 are pivotally attached via fastening elements 115 to lower ramp section 30. Also pivotally attached to base section 15 via fastening elements 115 are telescoping supports 80. The opposite ends of telescoping supports 80 are pivotally attached to upper ramp section 20 with fastening elements 115.

One side or edge of upper ramp section 20 is attached, via its bottom surface, to the top edge of base section 15, via its top surface, with strap hinges 90, so that upper ramp section 20 folds flat against base section 15. The edge of upper ramp section 20 opposite hinge 90 is attached via its top surface to the top surface of one edge of middle ramp section 25 by a continuous hinge **50*a* so that middle ramp section 25 folds flat against upper ramp section 20. The edge of middle ramp section 25 opposite hinge 50*a* is attached via its bottom surface to the bottom surface of one edge of lower ramp section 30 by a continuous hinge 50*b* so that lower ramp section 30 folds flat against middle ramp section 25. By alternating in a predetermined fashion from attachment via the lower surface of upper ramp section 20 for strap hinge 90, to upper surface attachment for continuous hinge 50*a* and again to lower surface attachment for continuous hinge 50*b*, sections 15, 20, 25, and 30 fold together in an accordion-like manner in the closed position, and unfold into a ramp-like arrangement for the open position. Excepting the connection between base section 15 and upper ramp section 20**, the sections of the boat boarding apparatus are hinged together in such a manner that the hinged adjacent sides of the sections butt together in a predetermined manner when the device is in the open position, thusly acting as a mutual stop for the sections, providing a method of increasing the rigidity of the boat boarding apparatus by preventing the sections from moving beyond their operational positions when weight is applied to the boat boarding apparatus.

In the illustrated embodiment of FIG. 1, horizontally disposed step 40 is attached at one edge to an edge of vertically suspending section 35 via continuous hinge 50*d* in such a manner that step 40 will nest inside the frame of suspending section 35 for the closed position, and be substantially perpendicular to suspending section 35 for the open position. The edge of vertically suspending section 35 opposite hinge 50*d* is attached to the edge of lower ramp section 30 opposite continuous hinge 50*b* with continuous hinge 50*c* in a predetermined fashion so that a combination of nested step section 40 and suspending section 35 will fold essentially flat against lower ramp section 30 for the closed position.

Figure 2:
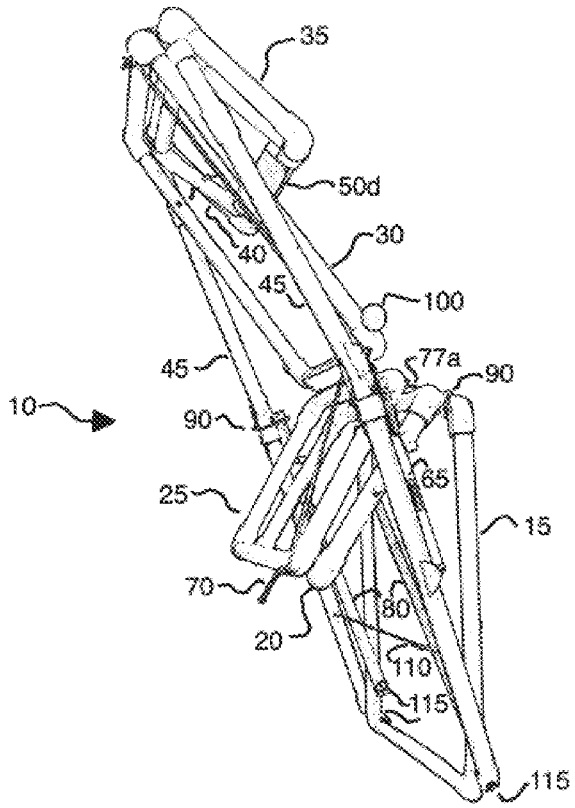
FIG. 2 is a phogtograph of the boat boarding apparatus in a partially open/dosed position, in accordance with the present invention.

As shown in FIG. 1, when in the open position, folding arms 45 provide cantilevered support for the combination of sequentially attached sections 20, 25, 30, 35 and 40, resulting in the combined sections essentially forming a ramp-like configuration with an attached lower step. As indicated by Portion 23 in FIG. 3 and in the enlargement of Portion 23 shown in FIG. 7, folding arms 45 comprise a strap hinge 93, a latch 60, a latch receiver 63 and a pneumatic damper 65. Latch 60 and latch receiver 63 serve as a method to lock arms 45 in an essentially rigid open position when the arms are unfolded, thus providing cantilevered support for the boat boarding apparatus. Pneumatic damper 65 is mounted in such a manner as to transverse the hinged joint of arm 45 and is a safety feature further discussed in more detail in operations below. Between folding support arms 45 is an optional restraining line 110, to facilitate maintaining the proper distance between the arms. Also depicted in FIGS. 1, 2, and 3 is a bumper 100, which serves as a method of limiting the motion of folding arms 45 during opening and closing operations. Further support and rigidity are provided by extended and locked telescoping supports 80. Telescoping supports 80 are held in the extended position by snap buttons 85, providing a method of locking the supports.

Figure 5:
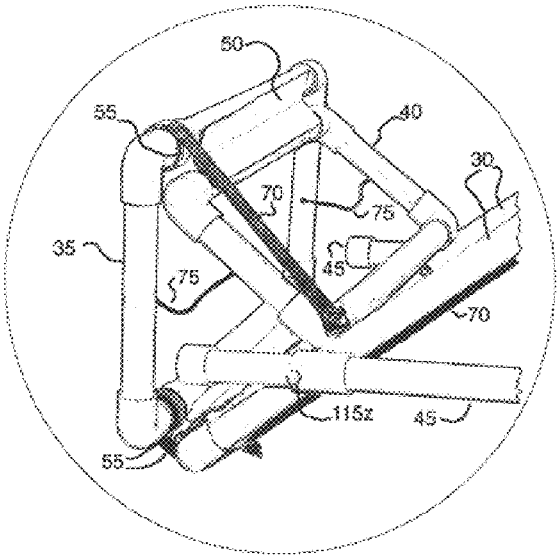
FIG. 5 is a photograph of an enlargement of Portion 38 shown in FIG. 3, in particular of the controlling line and plain bearings of the lower segments of the apparatus in a partially open position, in accordance with the present invention.
Figure 6:
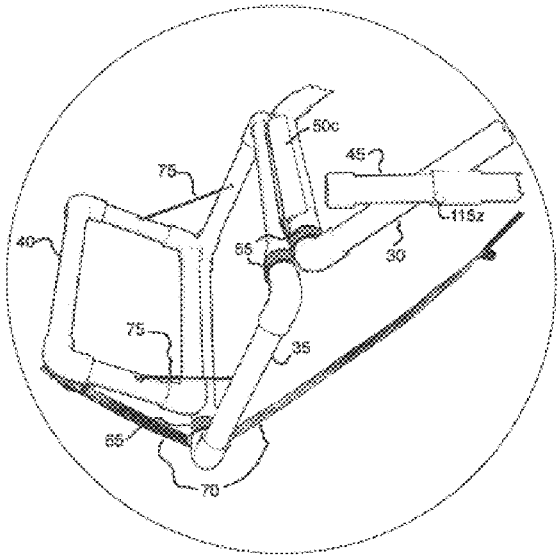
FIG. 6 is a photograph of an enlargement of Portion 53 shown in FIG. 1, of the lower segments of the apparatus in a fully open position, in accordance with the present invention.

FIG. 5 is an enlargement of Portion 38 indicated in FIG. 3, and FIG. 6 is an enlargement of Portion 53 indicated in FIG. 1 of the illustrated embodiment of the boat boarding apparatus, depicting further details of the current invention. A controlling line 70, comprising a flat web strap connected to a nylon cord, is attached to the edge of step section 40 opposite the hinged edge of step section 40. Plain bearings 55 are positioned on the framework of sections 30 and 35 in such a manner as to facilitate the sliding movement of controlling line 70 around the frames of lower ramp section 30 and vertically suspending section 35. Also shown in FIGS. 5 and 6 are supporting lines 75 which serve to hold step section 40 in a predetermined, essentially horizontal position when the boat boarding apparatus is in the fully open position.

Figure 4:
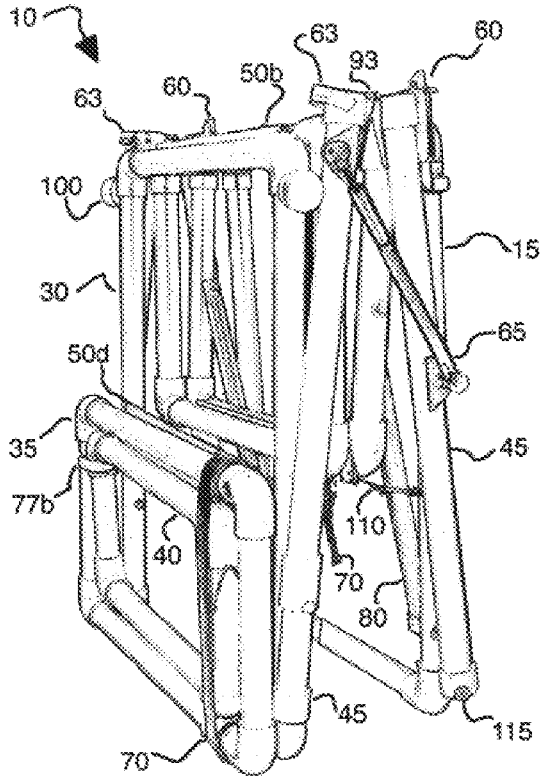
FIG. 4 is a photograph of the boat boarding apparatus in the completely closed position, in accordance with the present invention.

FIG. 4 depicts the illustrated embodiment of the inventive device in the closed position. As shown, support arms 45 are folded, telescoping supports 80 compressed, and sequentially hinged sections 15, 20, 25, 30, 35 and 40 are folded essentially flat against one another in an accordion-like fashion, resulting in a compact arrangement. The nested combination of section 35 and step 40 are held to folding arm 45 by holding strap 77*b*. While velcro straps are used in the illustrated embodiment, the applicants realize that other methods of holding the inventive device in the dosed position, such as, but not limited to, latches, snaps, or hooks, may be used by those skilled in the art.

Figure 8:
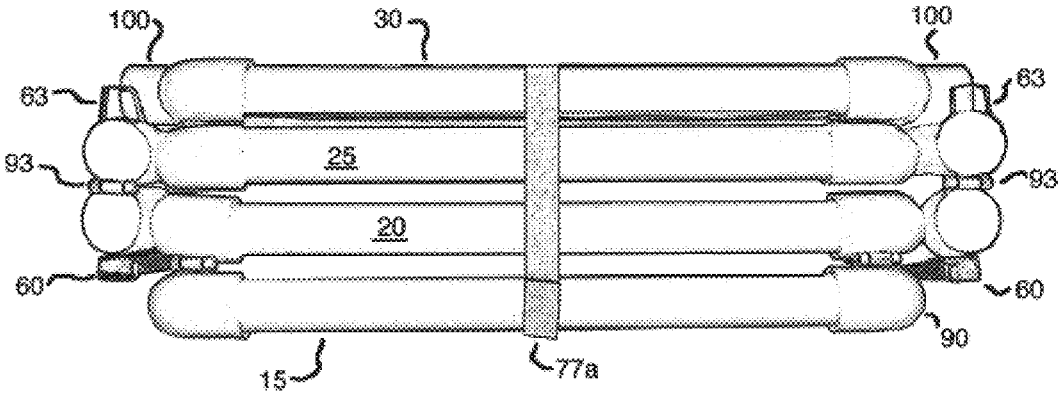
FIG. 8 depicts a top view of the boat boarding apparatus in the closed position, in accordance with the present invention.
Figure 7:
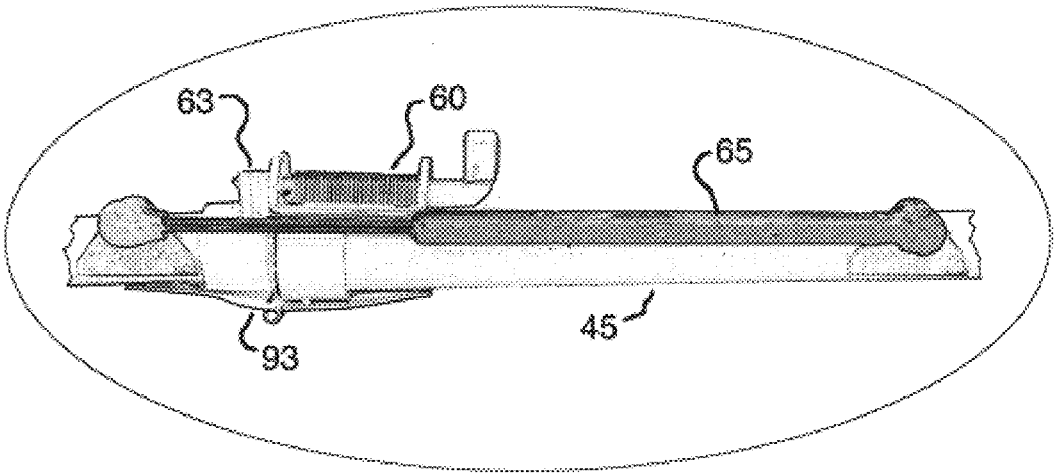
FIG. 7 is a photograph of an enlargement of Portion 23 shown in FIG. 3, in particular of the hinged area of a folding support arm, featuring the latch and receiver, and the pneumatic damper, in accordance with the present invention.

FIG. 8 depicts a top view of the apparatus generally indicated at 10, showing holding strap 77*a* implemented between base section 15 and lower ramp section 30, providing a method of holding the boat boarding apparatus in the closed position.

ADVANTAGES

From the description above, a number of advantages of our articulated, collapsible boat boarding apparatus become evident:

(a) The boat boarding apparatus provides support for loads of various weights without relying on floatation devices or structural adjustment.

(b) Deployment of the boat boarding apparatus is accomplished without tools.

(c) The invention is scalable for boats and other structures of various sizes.

(d) Sections of the inventive device serve as frames for the attachment of materials, resulting in planar surfaces suitable for walking or stepping upon.

(e) The planar walking surface may be comprised of any suitable materials, attached in any suitable manner, providing a wide range of options for design and marketing considerations.

(f) The boat boarding apparatus may be configured for usage by people.

(g) The boat boarding apparatus is permanently or removably mountable to a wide variety of boats and other structures by any means deemed suitable by those skilled in the art.

(h) The boat boarding apparatus may be portable.

OPERATION FIGS. 1, 2, 3, & 4

Operation of the boat boarding apparatus is predicated upon the assumption that the inventive device has been permanently or removably affixed to an substantially vertical element of a boat, or other structure (not shown), in a manner previously determined by those skilled in the art. Due to the multitude of variables involved in such attachment, including the requirement of determining how far above the water surface to mount for any particular embodiment of the boat boarding apparatus, and compensating for angular and material differences presented by various receiving structures, the means of attachment is not included within the scope of the present invention, and the lack of specification of attachment in no way limits the range and spirit of the inventive device, rather it positions the boat boarding apparatus for more universal adaptation and usage.

Therefore, with the inventive device permanently or removably attached to an essentially vertical element of a boat or other structure via base section 15, and in the closed position as shown in FIG. 4, operation of the preferred embodiment is as follows:

By grasping the lower segments of folding support arms 45 and lifting, the lower portion of the apparatus, comprising the outer segments of arms 45, lower ramp section 30, and the nested combination of suspending section 35 and step section 40, is raised upward, whereby folding support arms 45 are straightened, allowing spring-loaded latches 60 to engage with latch receivers 63, thereby locking arms 45 in an essentially rigid open position, resulting in the boat boarding apparatus being in a partially open position. At this point holding strap 77*b* is undone to release the nested combination of suspending section 35 and step section 40. The boat boarding apparatus is now in the position indicated by FIG. 2. Then, while holding onto the raised portion of the inventive device, holding strap 77*a* is released. Subsequently, the raised portion of the boat boarding apparatus is lowered and released. Next, by lifting up on upper ramp section 20, telescoping supports 80 are extended to the point where snap buttons 85 engage, thereby rigidly supporting upper ramp section 20. During these actions, the portion of folding support arm 45 that extends beyond fastening element 115*z* does raise the nested combination of suspending section 35 and step section 40 into a partially open position. At this point, the boat boarding apparatus appears as shown in FIG. 3.

The next step in deployment is to pull on controlling line 70, its movement around the frameworks of lower ramp section 30 and suspending section 35 facilitated by plain bearings 55, until step section 40 finishes unfolding from its nested position within vertically suspending section 35 and the two sections swing outward and downward, resulting in the boat boarding apparatus being in the fully open position as depicted in FIG. 1. Assuming proper installation of the inventive device on a boat or other structure, the boat boarding apparatus now forms a substantially rigid, cantilever-supported, ramp-like device, with a suspended step deployed under the water's surface by a predetermined amount. The applicants have chosen to include controlling line 70 and associated plain bearings 55 in the illustrated embodiment to facilitate smooth deployment while opening the boat boarding apparatus, however, the device will open fully without controlling line 70 when the raised portion is lowered and released with sufficient speed and momentum, and the presence or absence of controlling line 70 and plain bearings 55 is covered by the scope and range of the invention. The applicants also realize that other methods of facilitating deployment of the boat boarding apparatus may be available to those skilled in the art and fall within the range and scope of the invention.

Closure of the boat boarding apparatus 10 is accomplished in the following manner. Snap buttons 85 on telescoping supports 80 are depressed, allowing telescoping supports 80 to partially compress. Then, by pressing down in the general area of continuous hinge 50*a*, between upper ramp section 20 and middle ramp section 25, and subsequently lifting upward in the general area of continuous hinge 50*b*, the inventive device is moved toward the partially closed position, which causes step section 40 to fall into a nested position within suspending section 35. At this point, holding strap 77*a* is implemented between base section 15 and lower ramp section 30 to restrain the inventive device in a partially closed position. The nested combination of suspending section 35 and step section 40 is then folded toward its substantially flat position against lower ramp section 30, resulting in the boat boarding apparatus being positioned as in FIG. 2. Holding strap 77*b* is then implemented to restrain the nested combination in its closed position. Spring-loaded latches 60 are then disengaged from their receivers 63, causing arms 45 to fold, allowing the raised portion of the apparatus to collapse toward the fully closed position, during which time bumpers 100 serve as a method to restrict the movement of arms 45 to their proper range of motion. Pneumatic dampers 65 provide a method of controlling the speed at which the inventive device may be opened and collapsed, a safety feature in the preferred embodiment. The applicants recognize the potential for the boat boarding apparatus to function without pneumatic dampers 65, or that other ways of providing for safe operation of the apparatus may be advanced by those skilled in the art.

The foregoing detailed description of the articulated, collapsible boat boarding apparatus has been provided for illustrative and descriptive purposes, and is not intended to be an exhaustive or limiting accounting of the scope or spirit of the invention. The applicants realize that while those skilled in the art will note the opportunity for suitable modifications, changes and substitutions to the inventive device, any such variations are deemed to fall within the scope and range of the invention as described previously and in the subjoined claims.

CONCLUSION, RAMIFICATIONS, AND SCOPE

Accordingly, the reader will see that the articulated, collapsible boat boarding apparatus of this invention can be used to safely provide stable access between a boat, or other structure, and water, can be lightweight and portable, can be permanently or removably attached to a boat or other structure, and can be easily deployed for usage and easily collapsed for storage. Furthermore, the boat boarding apparatus has additional advantages in that:

- It permits users of various weights without adjustment;
- It provides support without floatation devices which can negatively affect performance;
- It permits deployment and retraction without tools, providing quick and convenient utilization;
- It permits construction from a wide range of materials, providing a great variety of design permutations suitable for many market sectors;
- It is scalable and adaptable for boats and other structures of differing sizes.

Although the above description contains specifications, these should not be construed as limiting the scope of the invention but as merely providing illustration of some of the features of present embodiment of the invention. Other anticipated features of possible embodiments include construction for human usage, and providing for deployment by a person in the water.

Thus the scope of the invention should be determined by the appended claims and their legal equivalents, rather than by the examples given.

We claim:

1. An articulated, collapsible boat boarding apparatus, with an open and a closed position, providing structural basis for an inclined ramp, ultimately presenting a safe and stable method of transport between a boat, or other structure, and water, comprising, in combination:

a series of elements or sections, rectangular in nature, securely and sequentially connected in a linear fashion by hinges, comprising a base section, an upper ramp section, a middle ramp section, a lower ramp section, a suspending section, and a step section;

telescoping supports pivotally connected at one end to said base section and pivotally connected to said upper ramp section at their opposite ends, with means of locking said telescoping supports in an extended position;

folding support arms, each comprising two segments and a hinge, pivotally connected at one end to the base section and pivotally connected to said lower ramp section at their opposite ends, with means of locking said arms in said open position;

wherein said boat boarding apparatus is permanently or removably mountable to an essentially vertical element of said boat or other structure via the base section;

wherein said sections are hingedly connected one to another in such a fashion that the sections fold together into a compact space for said closed position;

wherein the boat boarding apparatus, in the open position and attached to said boat or other structure, presents a rigid, stable framework with said ramp sections disposed at an incline suitable for walking upon, with a hanging step section;

wherein the boat-boarding apparatus is strong and lightweight.

2. The boat boarding apparatus according to claim 1, wherein said ramp sections and said step section provide opportunities for attachment of material or fabric, wherein a combination of section and material forms a substantially planar surface suitable for walking or stepping upon;

wherein said suspending section provides a basis for attachment of netting or other material to prevent feet or other objects from passing through the suspending section.

3. The boat boarding apparatus according to claim 1, wherein the sections have an top face and a bottom face;

wherein the sections have a basal side or edge, and opposite said basal edge have an outward edge;

wherein the boat boarding apparatus is permanently or removably mountable to a boat, or other structure in an essentially vertical position via the base section with said bottom face adjacent to said structure and its basal edge positioned downward;

wherein the base, upper ramp, middle ramp, lower ramp, and suspending sections are hingedly connected one to another, outward edge to basal edge in such a fashion as to allow the sections to fold together as an accordion;

wherein the suspending section is hingedly connected to the lower ramp section in such a manner that the suspending section hangs in a substantially vertical stance when the boat boarding apparatus is in the open position;

wherein the step section is hingedly attached at its basal edge to the suspending section at its outward edge in such a manner as to allow the step section to nest within the suspending section for the closed position and to dispose the step section essentially perpendicular to the suspending section for the open position.

4. The boat boarding apparatus according to claim 1, further including means of preventing the sections from opening beyond their predetermined operational positions.

5. The boat boarding apparatus according to claim 1, further including means of securing the boat boarding apparatus in the closed position.

6. The boat boarding apparatus according to claim 1, further including means of securing the suspending section and nested step section in the closed position.

7. The boat boarding apparatus according to claim 1, further including means of facilitating deployment of the boat-boarding apparatus into the open position.

8. The boat boarding apparatus according to claim 1, further including means of maintaining proper distance between the folding arms.

9. The boat boarding apparatus according to claim 1, further including means of directing movement of the folding arms during opening and closing operations.

10. The boat boarding apparatus according to claim 1, further including means of controlling how quickly the boat-boarding apparatus collapses toward the closed position.

11. The boat boarding apparatus according to claim 1, further including means of supporting the step section in the open position.

12. The boat boarding apparatus according to claim 1, further including portability.

13. An articulated, collapsible boat boarding apparatus, with an open and a closed position, providing a method of safe and stable transport between a boat, or other structure, and water, comprising;

a series of rectangular frames or sections, securely and sequentially connected in a predetermined linear manner by hinges, comprising;

a first or base section being permanently or removably mountable in an essentially vertical position to a substantially vertical element of said boat;

a plurality of sections that are disposed in such a fashion as to present an inclined ramp suitable for walking upon when said boat-boarding apparatus is in said open position;

a step section, disposed in an substantially horizontal attitude when the boat boarding apparatus is in said open position;

means of securely supporting the sections in the open position;

wherein the sections fold together as an accordion into said closed position;

wherein deployment of the boat boarding apparatus is accomplished without tools;

wherein said ramp and step sections provide opportunities for attachment of material, or fabric, in such a manner that a combination of section and material results in an essentially planar surface suitable for walking or stepping upon;

wherein said series of sections collapses into a compact space for the closed position and extends into an inclined ramp with attached step when in the open position;

wherein the boat boarding apparatus is scalable for boats of differing sizes;

wherein the boat boarding apparatus may be portable;

wherein usage of the boat boarding apparatus as a method of transport between boat and water does not require the use of hands;

whereby, with material affixed to the ramp and step sections and the inventive device mounted to said boat, in the open position, the boat boarding apparatus presents a new method for safe and stable transport between boat and water.

* * * * *